US007611416B1

(12) United States Patent
Mattina et al.

(10) Patent No.: US 7,611,416 B1
(45) Date of Patent: Nov. 3, 2009

(54) CUE STICK APPARATUS AND METHOD

(76) Inventors: Anthony J. Mattina, 4673 Muirfield Ave., Brunswick, OH (US) 44212; Randy J. Morris, 4431 Fallowfield La. SW., Lilburn, GA (US) 30047

( * ) Notice: Subject to any disclaimer, the term of this patent is extended or adjusted under 35 U.S.C. 154(b) by 80 days.

(21) Appl. No.: 11/750,752

(22) Filed: May 18, 2007

(51) Int. Cl.
*A63D 15/00* (2006.01)

(52) U.S. Cl. ..... 473/2; 473/42; 473/43

(58) Field of Classification Search ..... 473/2, 473/1, 42, 43, 44, 48
See application file for complete search history.

(56) References Cited

U.S. PATENT DOCUMENTS

| | | | | | |
|---|---|---|---|---|---|
| 529,731 | A | | 11/1894 | Gschwendtner | |
| 690,617 | A | * | 1/1902 | Ruhland | 473/42 |
| 870,491 | A | | 11/1907 | Callaghan | |
| 1,092,189 | A | | 4/1914 | Varian | |
| 2,014,788 | A | * | 9/1935 | Strickler et al. | 473/3 |
| 2,352,294 | A | * | 6/1944 | Stapff | 473/46 |
| 2,931,649 | A | * | 4/1960 | Furda | 473/42 |
| 3,416,794 | A | | 12/1968 | Ciano | |
| 3,534,959 | A | | 10/1970 | Elswick | |
| 3,836,145 | A | * | 9/1974 | Frejd | 473/42 |
| 4,053,153 | A | * | 10/1977 | Josenhans | 473/43 |
| 4,147,346 | A | | 4/1979 | Giannetti | |
| 4,688,796 | A | * | 8/1987 | Wright | 473/2 |
| 5,275,398 | A | * | 1/1994 | Compton | 473/2 |
| D354,106 | S | * | 1/1995 | Thompson | D21/726 |
| 5,478,282 | A | | 12/1995 | Possum et al. | |
| 5,554,075 | A | * | 9/1996 | Glazer | 473/2 |
| 5,704,842 | A | | 1/1998 | Petrusek | |
| D391,614 | S | * | 3/1998 | Meredith | D21/726 |
| 5,738,595 | A | * | 4/1998 | Carney | 473/209 |
| 5,785,602 | A | | 7/1998 | Morabito | |
| 6,042,481 | A | | 3/2000 | Walker et al. | |
| 6,117,019 | A | * | 9/2000 | Taylor | 473/46 |
| 6,155,929 | A | * | 12/2000 | Chipman | 473/2 |
| 6,220,963 | B1 | * | 4/2001 | Meredith | 463/37 |
| D453,364 | S | * | 2/2002 | Brothers | D21/726 |
| 6,402,628 | B1 | | 6/2002 | Neil | |
| 6,419,588 | B1 | | 7/2002 | Watlack et al. | |
| 6,929,555 | B2 | | 8/2005 | Morton | |
| 7,118,492 | B2 | | 10/2006 | Hung | |
| 2008/0090670 | A1 | * | 4/2008 | Liu | 473/2 |

FOREIGN PATENT DOCUMENTS

| | | | |
|---|---|---|---|
| GB | 2 171 919 A | | 9/1986 |
| GB | 2239400 A | * | 7/1991 |
| GB | 2 251 808 A | | 7/1992 |

* cited by examiner

*Primary Examiner*—Mitra Aryanpour
(74) *Attorney, Agent, or Firm*—Christopher L. Parmelee; Walker & Jocke

(57) ABSTRACT

A method and apparatus for practicing with a cue stick is provided. The method may include mounting an adapter to the outer surface of a cue stick such that at least one portion of the outer surface of the adapter: extends in a direction parallel to the central longitudinal axis of the cue stick; and extends adjacent at least a portion of the back half of the cue stick. The method may also include moving the cue stick to slide the outer surface of the adapter against at least one guide surface. Movement of the cue stick is in a direction that extends along the central longitudinal axis of the cue stick and a minimum distance between the central longitudinal axis of the cue stick, and the at least one guide surface in contact with the at least one portion of the outer surface of the adapter remains constant.

20 Claims, 13 Drawing Sheets

CUE STICK APPARATUS AND METHOD

A cue stick (or "cue") is an item used with games such as billiards, snooker, and pool to hit and drive a ball across a table. FIG. 1 shows a top view example of a cue stick 20 above a pool table 16. A typical cue stick may be about 1.5 meters (about 5 feet) long and have a weight of 510-600 grams (18-21 ounces). Cue sticks may be constructed as one piece items or with multiple parts which can be disassembled for easier storage and transportation. The heavier and larger diameter portion of the cue stick is referred to as the butt 2. The lighter and smaller diameter end is referred to as the shaft 4. For cues made of two pieces, the butt typically includes a projection such as a screw which is threaded into or otherwise engaged with a cavity in the shaft. The end of the shaft includes a tip 6 which is held in place with a cuff known as a ferrule 8.

When playing a cue sport, a player must first identify the direction that he wants to propel the cue ball in order to execute the shot that he is attempting. During this process, he develops an imaginary line on the table called the 'line of aim' 24. He then places his cue stick directly above that line by bending at the waist and placing one hand 17 firmly on the table forming a bridge which secures the front of the cue stick from moving laterally off that line. He then grips the butt of the cue stick with his other hand 18 in order to slide the cue stick through the bridge along the line of aim. Although the location at which the ball is hit and the force that is applied by the cue stick may vary depending on the desired shot, better players of sports that use cue sticks are able to move the cue stick with a stroke that is consistent and uniform each time a ball is hit. In general, such a consistent and uniform stroke minimizes lateral (side to side) movement of the cue stick as it is moved back and then forward along the line of aim to hit a ball. Thus, a better player can hit a ball accurately along the line of aim, by keeping the central longitudinal axis of the cue stick lined up along the line of aim at all times during the shot on the ball.

For example as shown in FIG. 1, when moving the cue stick backward and forward prior to hitting a ball 30, a good player will maintain the back 21 of the cue stick in a location 12 that is in the same vertical plane 24 as the original location 10 of the cue stick, i.e. along the line of aim. Such a stroke, minimizes lateral movement of the back 21 of the cue stick consistently for each stroke.

However, a poor or average player may not be able to achieve the same motion in a consistent manner. For example as shown in FIG. 1, a poor or average player may continuously or randomly move the back 21 of the cue stick to a location 14 that is laterally offset from the vertical plane 24 of the original location 10 of the cue stick. As a result, when moving the cue stick in the forward direction toward the ball, the back 21 of the cue stick may not consistently return to the starting location 10 of the cue stick. As a result, the cue stick may be laterally angled differently when hitting the ball compared to when the player originally aligned the shot.

Variation in the lateral angle of the cue stick between aligning the shot and hitting the ball, can significantly decrease the accuracy of the shot. Thus there is a need for a tool and a method which can be used to train a player to make more accurate shots with a cue stick. There is also a need for a tool that can train a player to minimize lateral movement of the back of the cue stick during the back and forth motion of a cue stick stroke.

As shown from a top view perspective in FIG. 2, such a tool may include a guide 32 against which a side of the cue stick 20 is slid. Such a guide may reduce lateral movement compared to that shown in FIG. 1. However, such a guide will still cause a small amount lateral movement in cue sticks. This lateral movement is a consequence of the cue stick being tapered. As shown in FIG. 2, cue sticks are typically constructed with a generally conical shape in which the back end 21 of the stick has a larger diameter than a diameter of the front end 22 of the stick. When sliding a tapered portion of the cue stick adjacent such a guide 32, the diameter of the portion of the cue stick adjacent the guide 32 varies depending on the position of the cue stick during the stroke. Consequently, when using such a guide for training purposes, the guide may teach and/or reinforce a tendency of a player to laterally move the back of the cue stick during a cue stick stroke FIGS. 3 and 4 show exaggerated versions of a taper of a cue stick to illustrate the problem. FIG. 3 shows the cue stick being secured along the line of aim at the front by a bridge hand at a location 38 and adjacent the guide 32 in an original forward location 34 relative the ball 30. In this location the central longitudinal axis 40 of the cue stick is aligned with the center of the ball 30 along the line of aim 42. FIG. 4 shows the cue stick after moving backward from the ball while sliding through the bridge hand at location 38 and against the guide 32. Because of the taper in the cue stick and the fact that the bridge hand locks the front of the cue stick on the line of aim, the central longitudinal axis 40 of the cue stick is now positioned at an angle with respect to the original line of aim 42. Thus the guide causes the back of the cue stick (e.g. the butt) to become laterally offset from the original line of aim on the back stroke.

In this example, when moving the cue stick forward against the guide, the central longitudinal axis 40 of the cue stick will again become aligned with the center of the ball. However, as a training guide, such a guide may teach and/or reinforce a tendency to laterally move the cue stick on the back stroke when not using the guide. Then when moving the cue stick forward, absent the guide, the player may inconsistently return the cue stick to its original position with the central longitudinal axis of the cue stick aligned with the original line of aim. Such an inconsistent stroke will minimize the accuracy and precision at which the player can hit a ball along an intended line of aim when playing cue stick games such as billiards, snooker, and pool. Also, even if the player is able to consistently return the cue exactly along the path that was taught by the guide, the resulting stroke will still produce unwanted spin to the ball caused by the angular movement of the cue stick. Such an angular stroke can also minimize the accuracy at which the player can hit a ball along the intended line of aim.

To overcome this limitation on the guide shown in FIGS. 2-4, an embodiment includes a method and apparatus of guiding a tapered portion of a cue stick so that the central longitudinal axis of the cue stick does not become laterally offset on the back stroke. This may be is accomplished by placing an adapter such as a removable sleeve around a portion of the tapered cue stick. The sleeve provides the tapered cue stick with at least one outer surface that includes a portion that extends parallel with the central longitudinal axis of the cue stick. In this embodiment, the outer surface of the adapter is slid against a guide to practice a cue stick stroke.

The combination of a stationary bridge hand, a stationary guide, and the parallel outer surface of the sleeve prevents or at least minimizes lateral movement of the cue stick in a direction perpendicular to the central longitudinal axis of the cue stick. Use of the apparatus over time (with or without a pool/billiards table and balls) helps reinforce a uniform and consistent stroke which trains a player's muscles to minimize moving the back of the cue stick from side to side.

BEST MODES FOR CARRYING OUT INVENTION

Figure 1:
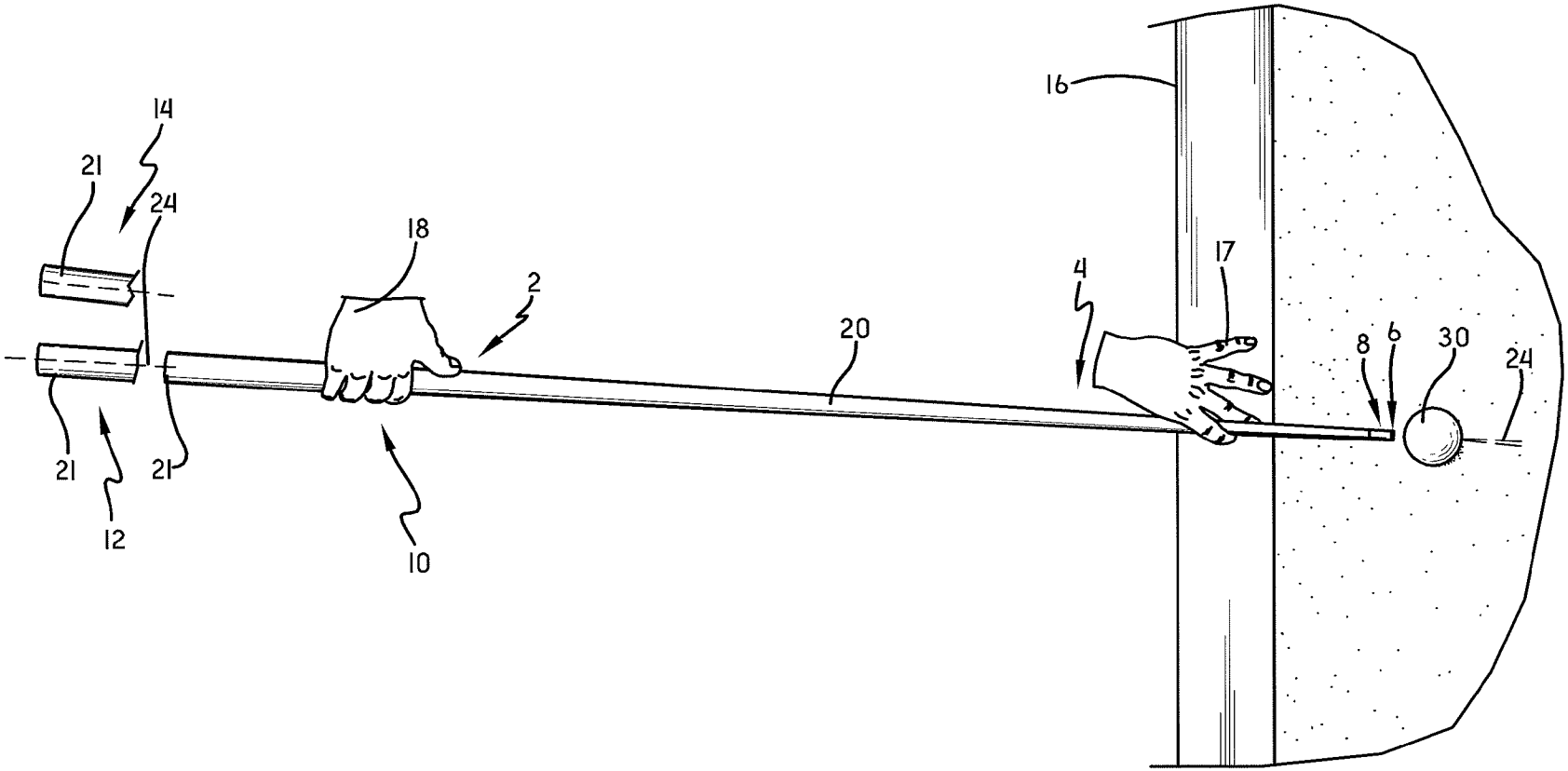
FIG. 1 shows a top plan view of a cue stick above a pool table.
Figure 2:
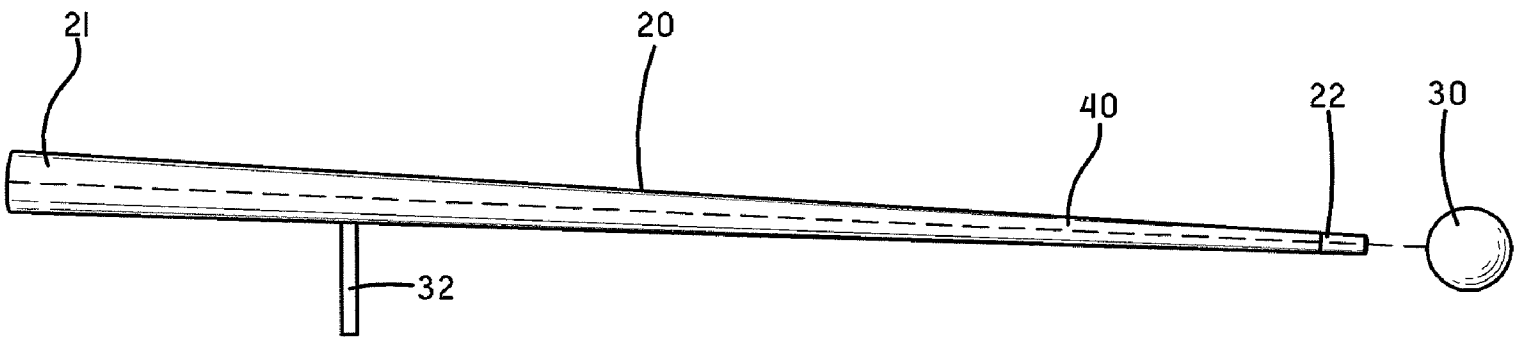
FIG. 2 is a top perspective view of a cue stick adjacent a guide against which the cue stick is slid.
Figure 3:
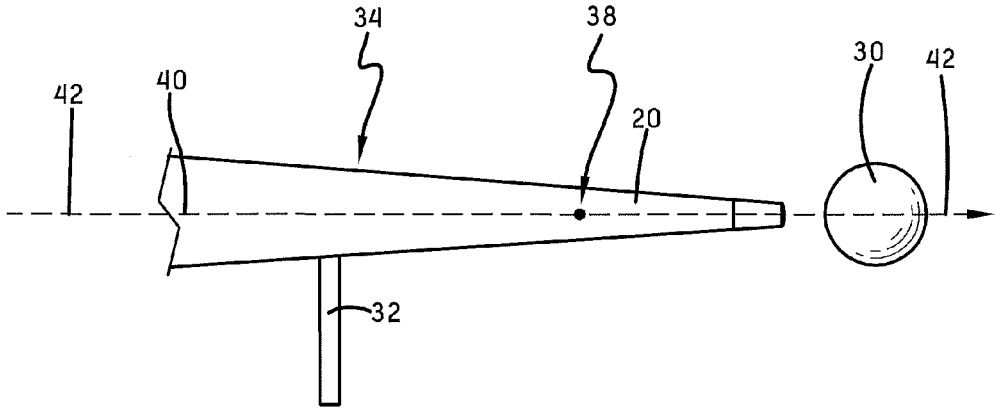
FIGS. 3 and 4 show exaggerated versions of a taper of a cue stick to illustrate a problem of using a guide with a cue stick.
Figure 4:
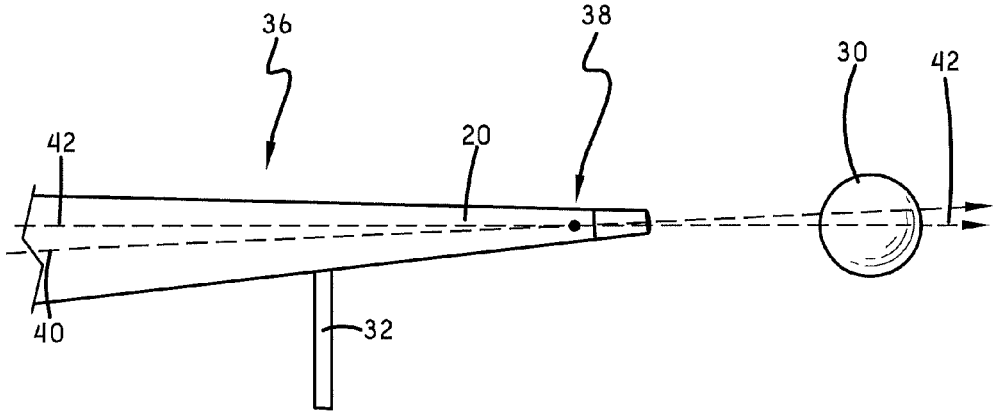
Figure 5:
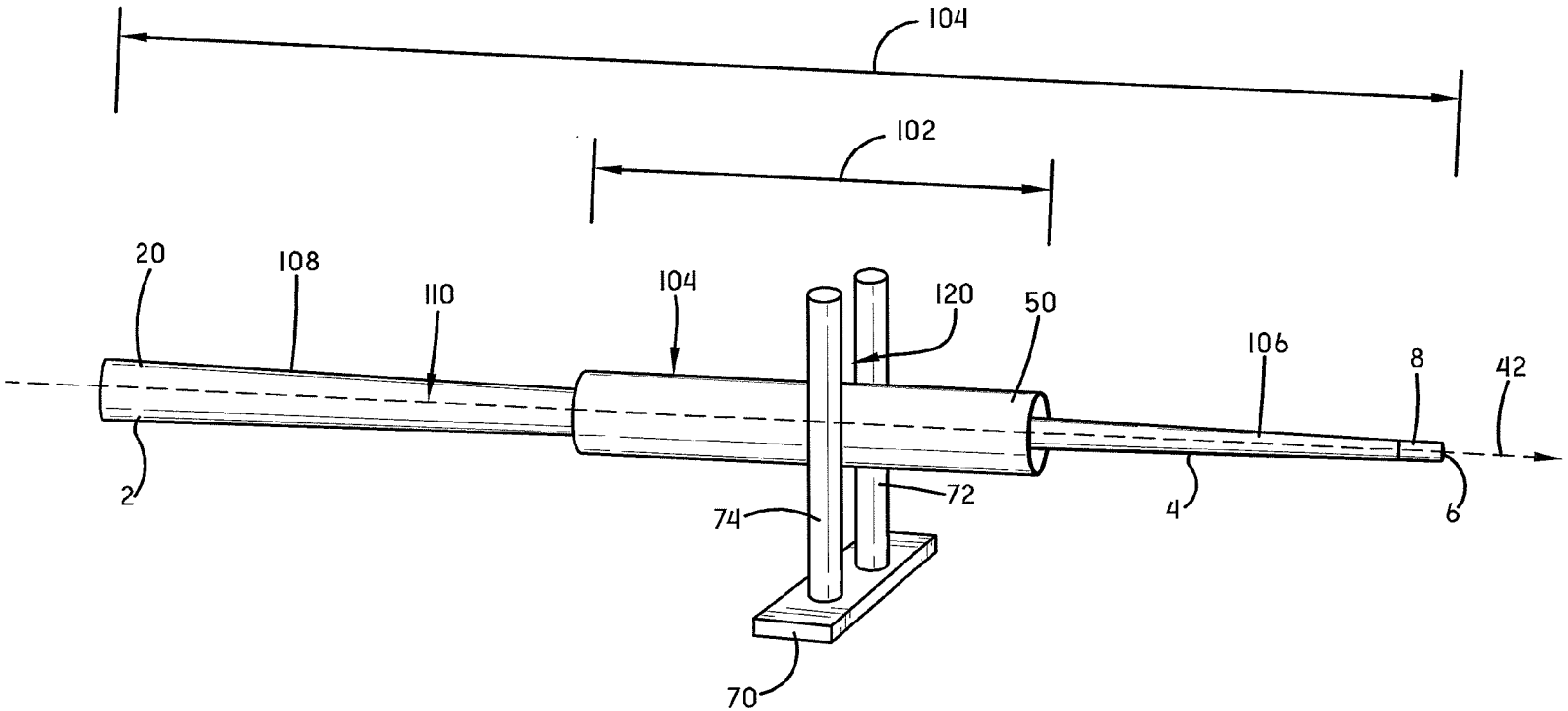
FIG. 5 is a side perspective view of an adapter with a cylindrical surface that is configured to slide through a guide.

Referring now to the drawings and particularly to FIG. 5, there is shown therein a side perspective view of a cue stick 20 that includes an example form of an adapter 50 mounted to the outer surface of the cue stick. This adapter 50 in combination with a guide 70 is operative to enable a user to practice a method of moving a cue stick and hitting balls with the cue stick in a manner which reinforces a smooth hitting stroke which has minimal lateral movement of the cue stick.

In this described embodiment, the adapter includes a longitudinal length 102 and an outer surface 104. Also, a cue stick for use with the adapter will have a longitudinal length 104, a front half 106, a back half 108, and a central longitudinal axis 110 extending through the front half and the back half of the cue stick. As discussed previously, a cue stick includes a tapered surface such that a maximum diameter of the back half 108 of the cue stick is greater than a maximum diameter of the front half 106 of the cue stick. As used herein, the front half of the cue stick includes the tip 6, ferrule 8 and at least portions of the shaft 4 of the cue stick. Also as used herein, the back half of the cue stick includes at least portions of the butt 2.

The adapter is configured to securely engage with the cue stick in a position on the cue stick in which at least one portion of the outer surface 104 of the adapter both: extends in a direction parallel to the central longitudinal axis 110 of the cue stick, and traverses at least a portion of the back half 108 of the cue stick. In this described embodiment, the longitudinal length 104 of the cue stick is greater than the longitudinal length of the adapter 102. As a result, in this embodiment, when the described adapter is securely mounted to the cue stick, both a portion of the front half 106 and a portion of the back half 108 of the cue stick are exposed to provide locations for a player's hands to hold and guide the outer surface of the cue stick during a shot.

Also, in this embodiment, the adapter is shown extending adjacent a portion of the front half 106 of the cue stick. However, it is to be understood that in alternative embodiments, the adapter may be configured to securely engage with the cue stick in a position which does not extend adjacent the front half 106 of the cue stick. Also, further alternative embodiments of the adapter may be configured to securely engage with the cue stick in a position which extends further behind the back end of the cue stick (e.g., past the butt of the cue stick).

Also, in this described embodiment, the adapter is shown with a cylindrical outer surface which extends around the cue stick. However, as will be shown in more detail below, it is to be understood that in alternative embodiments the outer surface of the adapter may include one or more generally flat surfaces orientated to extend parallel with the longitudinal axis 110 of the cue stick. Such flat surfaces may be orientated on one or more sides of the cue stick.

Figure 6:
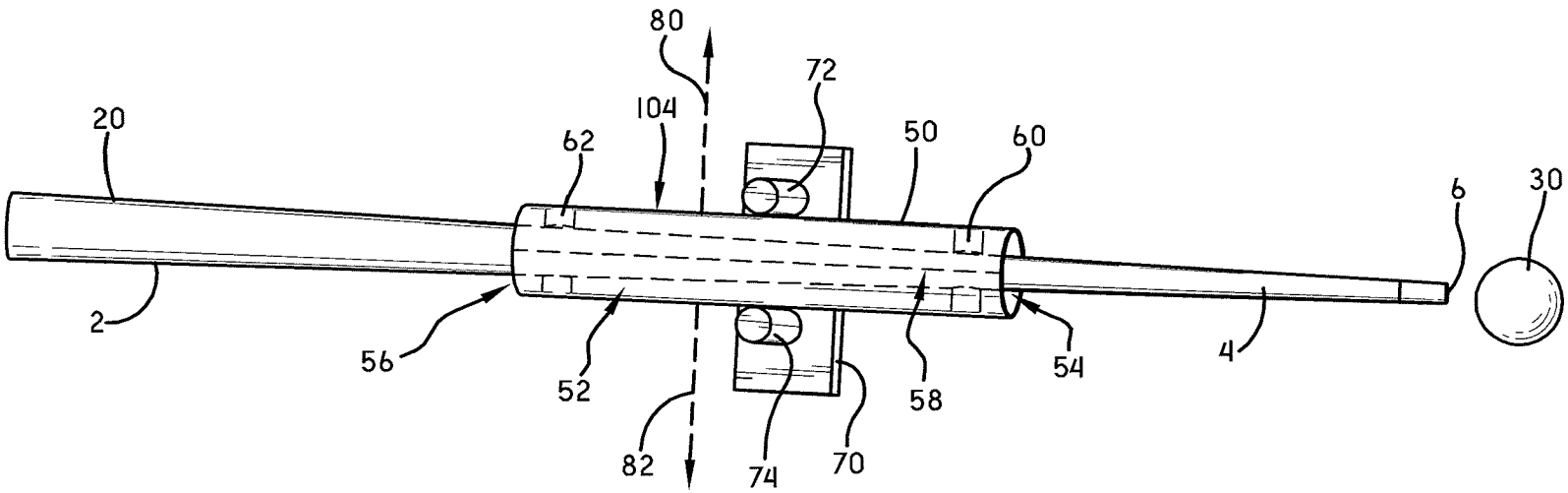
FIG. 6 is a top perspective schematic view of the adapter with the cylindrical surface that is configured to slide through the guide.

With respect to the embodiment of the adapter shown in FIG. 5, the adapter includes a sleeve with a cylindrical outer surface. FIG. 6 shows a top perspective schematic view of the adapter mounted to a cue stick. As shown in FIG. 6, the sleeve 50 includes a hollow interior 52 which extends between openings at the front end 54 and back end 56 of the sleeve. The sleeve includes a central longitudinal axis 58 that extends from the back end to the front end of the sleeve.

The hollow interior 52 of the sleeve includes a first inner diameter adjacent the front end 54 of the sleeve and a second inner diameter adjacent the back end 56 of the sleeve. Although the outer diameter is uniformly contestant between the front and back ends of the sleeve, in this described embodiment, the first inner diameter is smaller than the second inner diameter. As shown in FIG. 6, these differing inner diameters may be produced by including spacers 60, 62 such as rings or other members in the hollow interior adjacent the front and back ends of the sleeve. Such rings may include apertures of different sizes.

For example, the ring 60 adjacent the front of the sleeve may include an aperture with an inner diameter that corresponds to the outer diameter of a portion of the shaft 4 of the cue stick. Also the ring 62 adjacent the back of the sleeve may include an aperture with an inner diameter that corresponds to the outer diameter of a portion of the butt 2 of the cue stick. In an exemplary embodiment, these rings may be comprised of a deformable material (e.g. a foam, rubber) that compresses and/or moves to tightly grip the cue stick, when relatively wider portions of the respective shaft and butt of the cue stick slide through the apertures of the respective rings.

This described embodiment of the adapter may be mounted to the cue stick, by first sliding the narrower tip 6 of the cue stick into the opening in the back end 56 of the sleeve, through the hollow interior 52, and out of the opening in the front end 54 of the sleeve. This mounts the sleeve radially around the cue stick in a first position in which the cue stick extends through the hollow interior. In this first position, the described rings cause the central longitudinal axis of the sleeve to be orientated at least one of parallel and coincident to the central longitudinal axis of the cue stick. As a result the cylindrical outer surface of the sleeve extends parallel to the central longitudinal axis of the cue stick.

Although in this embodiment the spacers of the sleeve correspond to at least two rings 60, 62 positioned at the front and back of the sleeve, it is to be understood that in alternative embodiments one or more other types of spacers may be used to align the cylindrical outer surface of the sleeve in the longitudinal direction to extend parallel to the central longitudinal axis of the cue stick. For example in an alternative embodiment, the sleeve may include a single deformable member with a hollow interior surface that is tapered to correspond to the taper of the cue stick. Also, in a further alternative embodiment, the sleeve may include a plurality of deformable members along the inner walls at each end of the sleeve which are operative to align the cue stick in the sleeve. In an exemplary embodiment, the size and type of inner deformable material included in the sleeve may be chosen to produce a gripping force which is sufficiently high to prevent the sleeve from sliding off the cue stick when the sleeve is slid against a guide during a typical stroke in which a ball is hit, and which are sufficiently low to enable a person to manually slide the cue stick out of the sleeve without using tools.

As shown in FIG. 5, while the adapter is attached to the cue stick, a player may practice hitting balls (or practice his/her stroke without hitting balls) by moving the cue stick relative the guide 70. This may be performed by securing the front end (e.g. shaft 4) of the cue stick on the line of aim 42 by forming a bridge with one hand and moving the cue stick with the other hand holding the butt 2 of the cue stick so as to slide the at least one portion of the outer surface 104 of the adapter along and in contact with at least one guide surface 120 of the guide. Back and then forward movement of the cue stick is carried out in a direction that extends along the central longitudinal axis 110 of the cue stick and along the line of aim 42. Thus, this described arrangement maintains the central longitudinal axis of the cue stick in the same vertical plain as the line of aim for a cue stick stroke.

Also, because the bridge hand secures one point of the cue stick along the line of aim and at least one portion of the outer surface 104 of the adapter extends in a direction parallel to the central longitudinal axis 110 of the cue stick, when the cue stick is moved in this described manner, the minimum distance between the central longitudinal axis 110 of the cue stick and the at least one guide surface 120 in contact with the at least one portion of the outer surface of the adapter, remains constant. Thus the described guide and adapter are operative to resist lateral (e.g., horizontal) movement of the cue stick (or at least portions of the cue stick adjacent the guide) in directions perpendicular to the central longitudinal axis of the cue stick.

As shown in FIG. 6, the guide 70 may include vertical posts 72, 74 on both sides of the adapter 50. The corresponding guide surfaces of these posts are operative to resist in two directions 80, 82, lateral movement perpendicular to the central longitudinal axis of the cue stick. These posts include guide surfaces which are spaced apart a distance that corresponds to the distance between the outer surfaces 104 of the adapter on opposed sides of the cue stick. For example, for an adapter with the cylindrical outer surface shown in FIG. 6, the spaced apart distance between guide surfaces corresponds to the outer diameter of the adapter.

In an exemplary embodiment, the distances between the guide surfaces may be as close as possible to the width or diameter of the outer surfaces of the adapter to achieve a desirable balance between minimal friction and minimum lateral movement of the adapter. However, in alternative embodiments, distances between the guide surfaces may be slightly larger or smaller than the width/diameter of the adapter, by design or as a result of manufacturing error, wear, thermal expansions/contraction or other factors which affect the dimensions of the guide and/or adapter.

Also, in an alternative embodiment, the guide may include a guide surface on only one side of the adapter. Such guide surface may be used to limit in only one direction lateral movement perpendicular to the central longitudinal axis of the cue stick. Also, as shown in FIG. 6, the guide surfaces may have cylindrical surfaces adjacent the adapter (e.g., cylindrical vertical posts). The combination of cylindrical guide surfaces and a cylindrical outer surface of the adapter may minimize the amount of contact surface area between the guide and adapter and thereby minimize the amount of friction between the guide and adapter. Further, the outer surfaces of the adapter and the guide surfaces may be comprised of materials such as smooth plastics, metals or other materials which minimize friction between the guide and adapter.

Also, in alternative embodiments, the guide surfaces may have other shapes. For example, rather than having a cylindrical surface, the guide surfaces may have a generally flat surface (e.g., vertical rectangular posts). Such flat surfaces may further serve to minimize lateral pivoting of the cue stick which could occur with the cylindrical guide surfaces shown in FIG. 6 if the bridge hand is not secure.

In a further embodiment, to minimize lateral pivoting of the cue stick, the guide may include four laterally spaced apart guide surfaces extending in parallel in a vertical direction.

Figure 7:
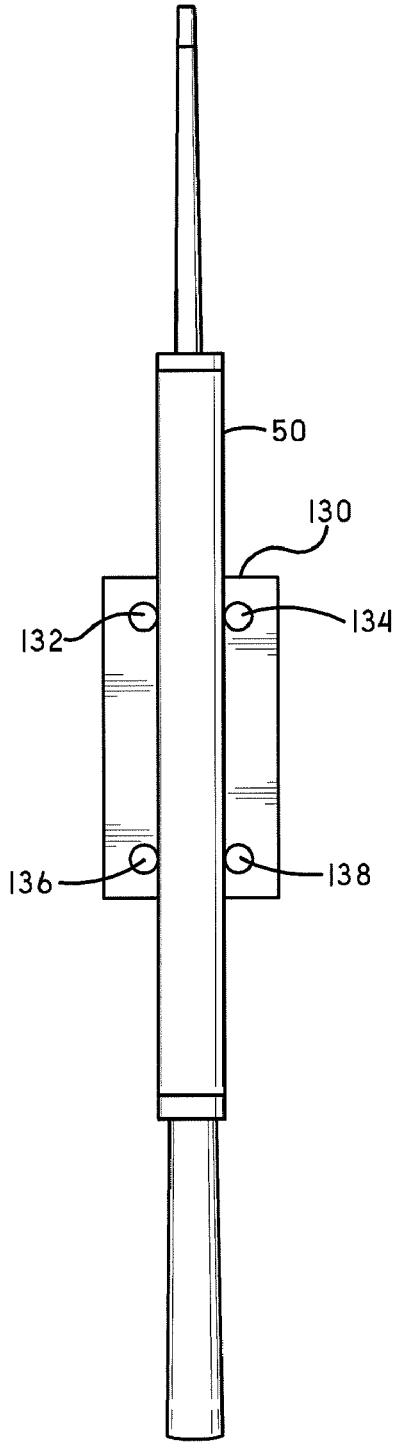
FIG. 7 is a top plan view of the adapter with the cylindrical surface that is configured to slide through an alternative embodiment of the guide.

FIG. 7 shows a top view of such a guide 130. Here the guide includes four vertical posts 132, 134, 136, 138. When the adapter 50 is inserted in the guide, a first pair 132, 136 of the posts is positioned so that the posts' respective guide surfaces contact the outer surface of the adapter on a first side of the cue stick; and a second pair 134, 138 of the posts is positioned so that their respective guide surfaces contact the outer surface of the adapter on a second side of the cue stick. Such an arrangement of posts is operative to resist lateral movement of the entire cue stick in directions perpendicular to the central longitudinal axis of the cue stick.

Although in these described embodiments the guide is operative to limit lateral movement of the cue stick, these described guides may permit vertical movement of the cue stick. For example, as shown in FIGS. 8-12, the cue stick and adapter may be moved and positioned at various vertical heights and at varying vertical angles with respect to the guide 130 while the guide continually minimizes lateral movement of the cue stick.

Figure 14:
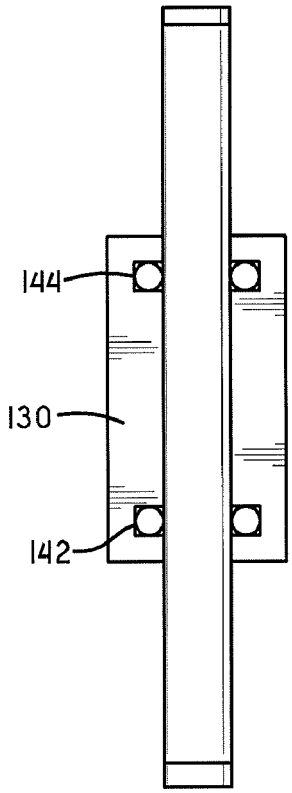
FIG. 14 shows a top plan view of the alternative embodiment in which the guide includes a pair of saddles upon which the adapter may slide.
Figure 13:
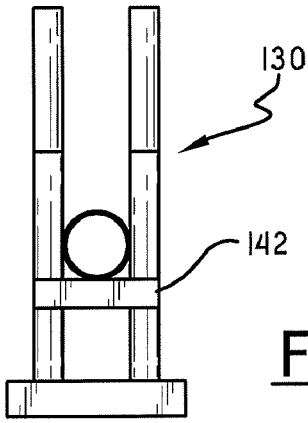
FIG. 13 shows a front side plan view of an alternative embodiment in which the guide includes a saddle upon which the adapter may slide.

Also, as shown in a front side view in FIG. 13 and a top view in FIG. 14, in a further alternative embodiment a guide 130 may include one or more removable or adjustable horizontal members 142, 144 supported by posts on each side of the guide. Such horizontal members may serve as saddles upon which the adapter may slide atop. Such saddles may be moved up or down on the posts to a position which may assist a player in aligning the cue stick at a desired vertical height and/or angle. Such saddles may include locking screws, cam operated latches, or other locking devices that are operative to rigidly fix the saddles to the posts of the guide. In this described embodiment, the saddles may be mounted in a plurality of different vertical positions with respect to the posts.

Figures 8, 9, 10, 11, 12:
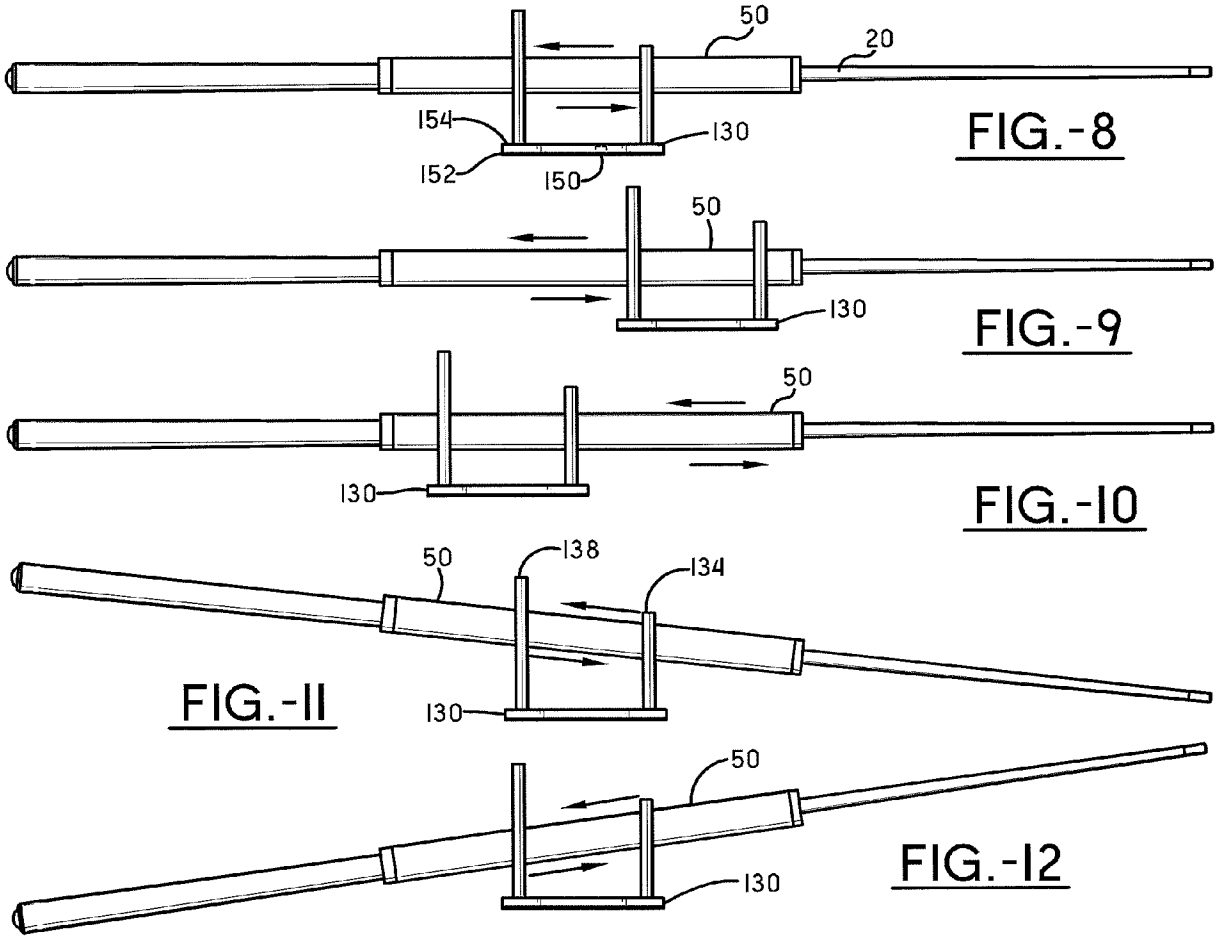
FIGS. 8-12 show side plan views of various orientations of a cue stick and adapter positioned in the guide.

In addition, as shown in FIG. 8, the described guides may include other features. For example, the guide 130 may include a base 154 that includes a threaded hole 150 adapted to mount the guide to a standard photography tripod. Further, the base 154 of the guide may include a high friction surface 152 such as a rubber pad that is operative to resist sliding movement of the guide when placed on a flat surface such a portion of a pool table or billiards table. Also, as shown in FIG. 11, the vertical posts 138 at the back of the guide may be vertically longer than the posts 134 at the front of the guide. Such a differential in sizes between the back and front posts may enable the cue stick to be placed at a relatively sharp downward angle towards the ball while minimizing the amount of space the front of the guide consumes.

Figure 15:
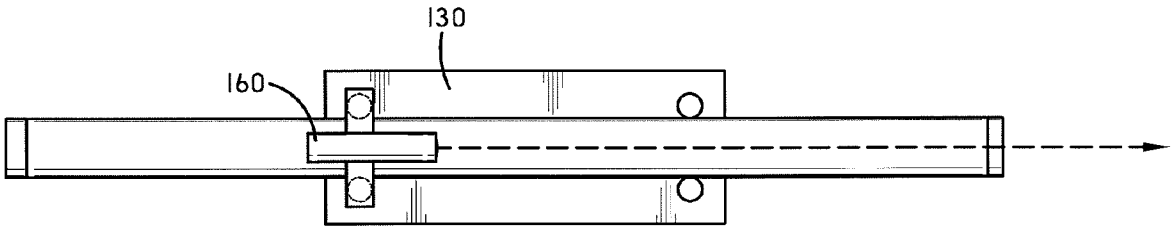
FIG. 15 shows a top plan view of an alternative embodiment in which the guide includes a laser operative to emit a visible line of light for use with aligning the guide.
Figure 16:
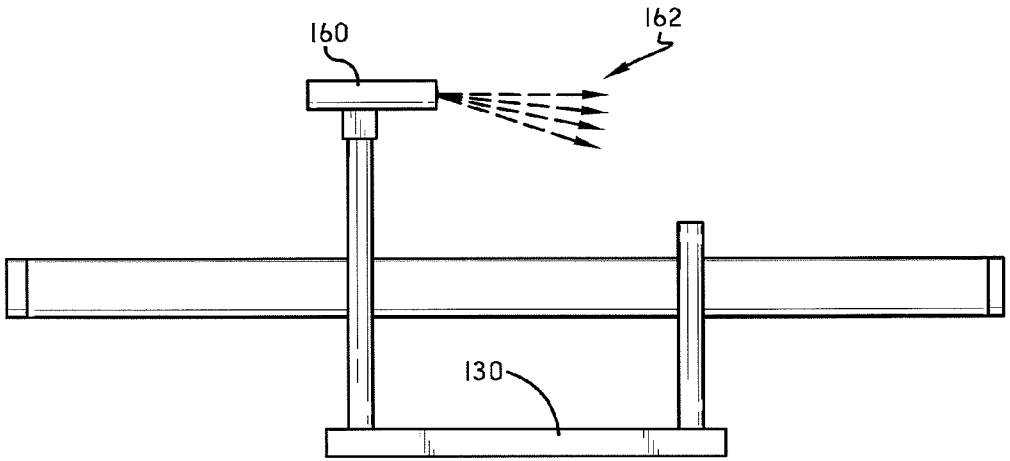
FIG. 16 shows a side plan view of the alternative embodiment in which the guide includes a laser operative to emit a visible line of light for use with aligning the guide.

In addition, as shown in FIGS. 15 and 16, a guide 130 may include a laser 160 mounted to either the front or back posts. Such a laser may be operative to emit visible light in a line and/or plane which assists in aligning the guide in a location suitable for positioning the cue stick to hit the ball towards a desired target. For example, as shown in FIG. 16, the laser may include optics capable of spreading the laser light 162 along a vertical plane that illuminates a visible line of light on the pool/billiards table. This visible line corresponds to a visible representation of the line of aim discussed previously. The laser may be mounted on the guide such that the visible line extends parallel to the longitudinal axis of the cue stick when sliding through the guide.

The guide may then be positioned to cause the visible line of light on the pool/billiards table to intersect with both the ball and the intended target for the ball. When the cue stick and adapter is slid through the guide, the cue stick travels in a direction that is coincident with the visible laser line formed on the table. As a result, the cue stick is properly positioned to hit the ball in the direction of the intended target for the ball.

Figure 17:
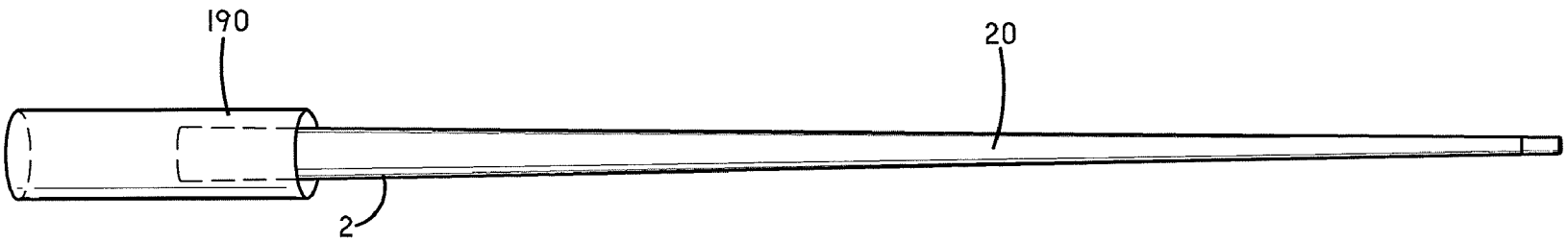
FIG. 17 shows a top perspective schematic view of an alternative embodiment of an adapter that is operative to extend off the butt of the cue stick.

In addition to the embodiments of the guide and adapter described above, it is to be understood that further alternative embodiments of the guide, adapter and combinations thereof may be used which are capable of minimizing lateral movement of the cue stick. For example, as shown in FIG. 17, a cylindrical sleeve adapter 190 (or an adapter with another configuration) may be capable of being mounted to the cue stick such that it extends passed the butt 2 of the cue stick but is still parallel with the central longitudinal axis of the cue stick. When in use the guide may be positioned behind the player on a tri-pod for example.

Figure 18:
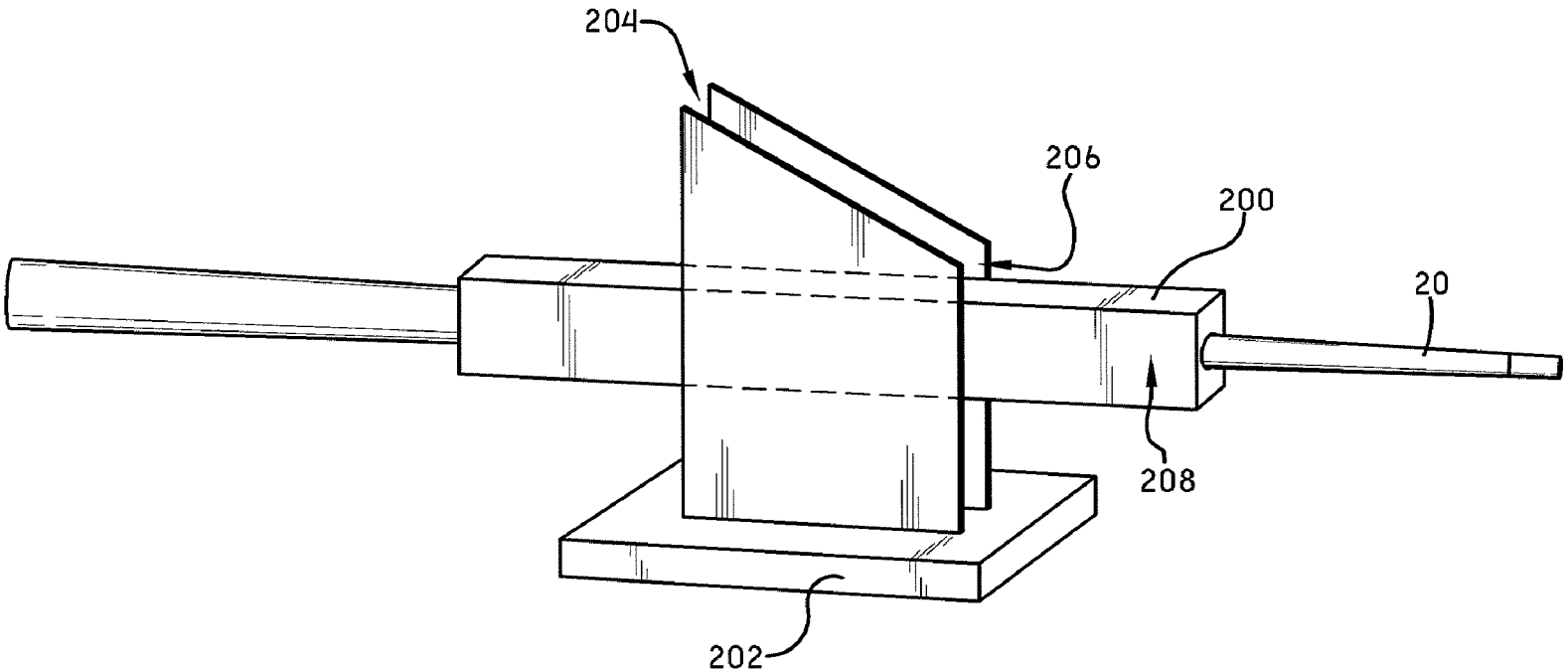
FIG. 18 shows a side perspective view of an alternative embodiment of an adapter that has a rectangular box shape and an alternative embodiment of a guide that includes flat parallel walls.

Further, as shown in FIG. 18, an alternative embodiment of the adapter may have a form such as a rectangular box 200 with side surfaces 208 that mount parallel to the longitudinal axis of the cue stick. Also, FIG. 18 shows an alternative embodiment of a guide 202, in which the guide surfaces 204, 206 correspond to flat surfaces on either side of the guide 202.

Figure 19:
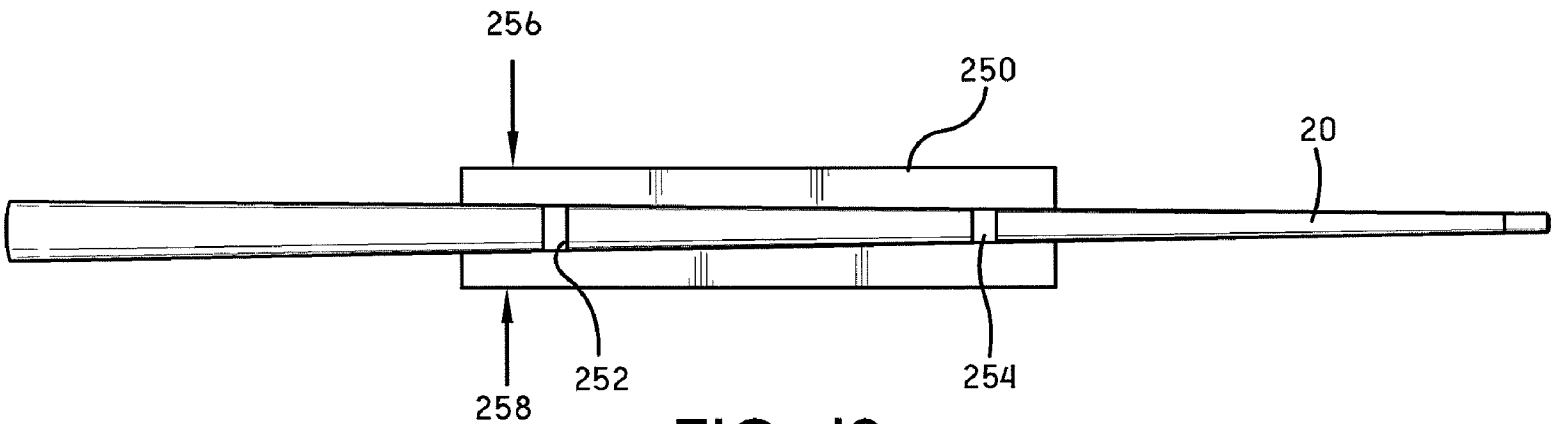
FIG. 19 shows a top plan view of an alternative embodiment of an adapter with a base that mounts under or over a cue stick.

FIG. 19 shows a top view of another alternative configuration of an adapter 250. Here the adapter includes a rectangular base 250 that is mounted to the underside of a cue stick. Such a rectangular base may include elastic straps 252, 254 that hold the adapter to the cue stick. The base may also include a cylindrical slot or other features in an upper surface that prevent the cue stick from sliding relative to the base 250. In this example, the side edges 256 and 258 of the base 250 correspond to the outer surfaces of the adapter which extend parallel to the longitudinal axis of the cue stick and which contact the guide surfaces of the guide.

Figure 20:
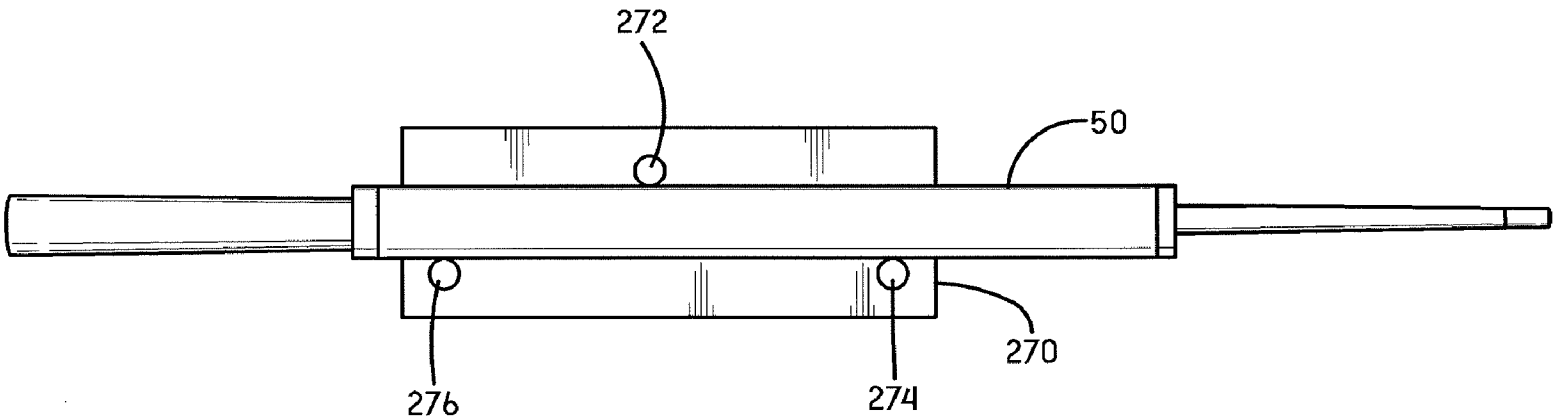
FIG. 20 shows a top plan view of an alternative embodiment of a guide that includes three vertical posts.

FIG. 20 shows a top view of another alternative embodiment of the guide. This embodiment of the guide 270 is similar to the guide 130 shown in FIG. 7. However, rather than having two vertical cylindrical posts oriented on each side of the adapter 50, here the guide includes a single vertical post 272 on one side of the adapter positioned intermediate of two vertical posts 274, 276 located on the opposite side of the adapter 50.

Thus the new cue stick apparatus and method eliminates difficulties encountered in the use of prior devices and systems, solves problems and attains the desirable results described herein. In the foregoing description certain terms have been used for brevity, clarity and understanding; however, no unnecessary limitations are to be implied therefrom, because such terms are used for descriptive purposes and are intended to be broadly construed. Moreover, the descriptions and illustrations herein are by way of examples, and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

We claim:

1. A method comprising:

a) mounting an adapter to an outer surface of a cue stick, wherein the adapter includes a longitudinal length, wherein the cue stick includes a longitudinal length, a front half, a back half, and a central longitudinal axis extending through the front half and the back half of the cue stick, wherein the longitudinal length of the cue stick is greater than the longitudinal length of the adapter, wherein a maximum diameter of the back half of the cue stick is greater than a maximum diameter of the front half of the cue stick, wherein the adapter is positioned on the cue stick such that at least one portion of the outer surface of the adapter:

extends in a direction parallel to the central longitudinal axis of the cue stick; and extends adjacent at least a portion of the back half of the cue stick, wherein the adapter extends adjacent portions of both the front half and the back half of the cue stick, wherein the adapter includes portions of the outer surface of the adapter positioned on opposed sides of the cue stick; and b) moving the cue stick to slide the at least one portion of the outer surface of the adapter against at least three guide surfaces of a guide, wherein the at least three guide surfaces are laterally spaced apart and extend in parallel in a vertical direction, wherein movement of the cue stick is in a direction that extends along the central longitudinal axis of the cue stick, wherein a minimum distance between the central longitudinal axis of the cue stick and the at least one guide surface in contact with the at least one portion of the outer surface of the adapter remains constant, wherein the cue stick moves in sliding contact with the at least three guide surfaces with each one of a first pair of the guide surfaces contacting a first portion of the outer surface on a first side of the cue stick, and with at least one further one of the guide surfaces contacting a second portion of the outer surface on an opposed second side of the cue stick, wherein the at least three guide surfaces resist lateral movement of the entire cue stick in directions perpendicular to the central longitudinal axis.

2. The method according to claim 1, wherein in (b) the guide includes a laser device mounted thereto and positioned to emit light in a visible line that extends parallel to the longitudinal axis of the cue stick, further comprising:

c) moving the guide to align the visible line to intersect a ball; and d) contacting the ball with an end of the cue stick.

3. The method according to claim 1, further comprising:

c) contacting a ball with an end of the cue stick;

d) subsequent to (c) removing the adapter from the cue stick; and e) subsequent to (d) hitting a ball with the end of the cue stick.

4. The method according to claim 1, wherein the adapter includes a sleeve, wherein the sleeve includes a cylindrical outer surface, wherein the sleeve includes a hollow interior, wherein the sleeve includes a back end and a front end, wherein the sleeve includes a length between the back end and the front end, wherein the length of the sleeve is less than the length of the cue stick, wherein the back end of the sleeve includes an opening to the hollow interior, wherein the front end of the sleeve includes an opening to the hollow interior, wherein the sleeve includes a central longitudinal axis that extends from the back end to the front end of the sleeve;

wherein (a) includes sliding the cue stick through the hollow interior of the sleeve to mount the sleeve radially around the cue stick in a first position in which the cue stick extends through the hollow interior with the cylindrical outer surface of the sleeve in the direction of the central longitudinal axis of the sleeve extending parallel to the central longitudinal axis of the cue stick;

wherein (b) includes moving the cue stick to slide the cylindrical outer surface of the sleeve in contact with the first pair of the guide surfaces on a first side of the cylindrical outer surface of the sleeve, and the at least one further guide surface on an opposed second side of the cylindrical outer surface of the sleeve.

5. The method according to claim 4, wherein in (a) the hollow interior of the sleeve includes a first inner diameter adjacent the front end of the sleeve, wherein the hollow interior of the sleeve includes a second inner diameter adjacent the back end of the sleeve, wherein the first inner diameter is smaller than the second inner diameter.

6. The method according to claim 5, wherein in (a) the hollow interior of the sleeve includes at least one deformable member, wherein the at least one deformable member includes a first aperture with the first inner diameter, wherein the at least one deformable member includes a second aperture with the second inner diameter.

7. The method according to claim 1, wherein in (b) the guide includes a base, wherein the base includes at least three spaced apart posts extending upwardly from the base, wherein the at least three posts respectively include the at least three guide surfaces.

8. The method according to claim 1, wherein in (b) the guide includes a base, wherein the base includes two vertical, spaced apart, and parallel flat wall surfaces in operative connection with the base, wherein a first one of the wall surfaces includes the pair of guide surfaces, wherein the second one of the wall surfaces includes the at least one further guide surface.

9. An apparatus comprising:

at least one adapter operative to removably mount to an outer surface of a cue stick, wherein the cue stick includes a longitudinal length, a front half, a back half, and a central longitudinal axis extending through the front half and the back half of the cue stick, wherein a maximum diameter of the back half of the cue stick is greater than a maximum diameter of the front half of the cue stick;

wherein the at least one adapter includes a longitudinal length that is less than the longitudinal length of the cue stick, wherein the at least one adapter includes an outer surface, wherein the at least one adapter includes a cylindrical sleeve that is operative to removably mount around the cue stick, wherein a hollow interior of the sleeve includes a first deformable ring with a first aperture with a first inner diameter adjacent a front end of the sleeve, wherein the hollow interior of the sleeve includes a second deformable ring with a second aperture with a second inner diameter adjacent a back end of the sleeve, wherein the first inner diameter is smaller than the second inner diameter, wherein when the cue stick is inserted into the sleeve, the first deformable ring adjacent the front of the sleeve and the second deformable ring adjacent the back of the sleeve are adapted to deform to tightly engage the sleeve with the cue stick such that the at least one adapter is mounted to the outer surface of the cue stick in a first position which orientates at least one portion of the outer surface of the at least one adapter to extend in a direction parallel to the central longitudinal axis of the cue stick and to extend adjacent at least a portion of the back half of the cue stick; and a guide, wherein the guide includes at least one guide surface operative to receive the at least one portion of the outer surface of the adapter in sliding contact therewith.

10. The method according to claim 9, wherein when the adapter is mounted to the cue stick and is in sliding engagement with the guide, the at least one guide surface is operative to resist lateral movement of the at least one portion of the outer surface of the adapter in sliding contact therewith in directions perpendicular to the central longitudinal axis of the cue stick.

11. The apparatus according to claim 10, wherein the guide includes at least two laterally spaced apart guide surfaces, wherein the adapter is operative to slide vertically between the at least two guide surfaces with the at least one portion of the outer surface of the adapter in contact with each of the at least two guide surfaces.

12. The apparatus according to claim 9, wherein the guide includes at least two laterally spaced apart guide surfaces, wherein the adapter includes a width, wherein a distance between the at least two guide surfaces corresponds to the width of the adapter, wherein the adapter is operative to simultaneously move relative to the guide between the at least two guide surfaces, in a direction parallel to the longitudinal axis of the cue stick and in a direction perpendicular to the longitudinal axis of the cue stick.

13. An apparatus comprising:

at least one adapter operative to removably mount to an outer surface of a cue stick, wherein the cue stick includes a longitudinal length, a front half, a back half, and a central longitudinal axis extending through the front half and the back half of the cue stick, wherein a maximum diameter of the back half of the cue stick is greater than a maximum diameter of the front half of the cue stick;

wherein the at least one adapter includes a longitudinal length that is less than the longitudinal length of the cue stick, wherein the at least one adapter includes an outer surface, wherein the at least one adapter is operative to mount to the outer surface of the cue stick in a first position which orientates at least one portion of the outer surface of the at least one adapter to extend in a direction parallel to the central longitudinal axis of the cue stick and to extend adjacent at least a portion of the back half of the cue stick, wherein the adapter when mounted to the cue stick includes portions of the outer surface of the adapter positioned on opposed sides of the cue stick; and a guide, wherein the guide includes at least three laterally spaced apart guide surfaces extending in parallel in a vertical direction and operative to receive the at least one portion of the outer surface of the adapter in sliding contact therewith, wherein the adapter mounted to the cue stick is operative to move in sliding contact with the at least three guide surfaces with each one of a pair of the guide surfaces contacting a first portion of the outer surface of the adapter on a first side of the cue stick, and with at least one further one of the guide surfaces contacting a second portion of the outer surface of the adapter on an opposed second side of the cue stick, wherein the at least three guide surfaces are operative to resist lateral movement of the adapter mounted to the cue stick in directions perpendicular to the central longitudinal axis of the cue stick, wherein the adapter is operative to slide vertically between at least two of the guide surfaces.

14. The apparatus according to claim 13, wherein the guide includes a laser device mounted thereto and positioned to emit light in a visible line, wherein the at least one guide surface is orientated such that the when the at least one portion of the outer surface of the adapter is slid in contact with the at least three guide surfaces, the longitudinal axis of the cue stick is capable of being aligned in parallel with the visible line.

15. The apparatus according to claim 13, wherein the adapter includes a sleeve operative to removably mount around the cue stick, wherein the sleeve includes a cylindrical outer surface, wherein the sleeve includes a hollow interior, wherein the sleeve includes a back end and a front end, wherein the sleeve includes a length between the back end and the front end, wherein the length of the sleeve is less than the length of the cue stick, wherein the back end of the sleeve includes an opening to the hollow interior, wherein the front end of the sleeve includes an opening to the hollow interior, wherein the sleeve includes a central longitudinal axis that extends from the back end to the front end of the sleeve, wherein the sleeve is operative to mount around the outer surface of the cue stick in a first position in which the cue stick extends through the hollow interior with the cylindrical outer surface of the sleeve in the direction of the central longitudinal axis of the sleeve extending parallel to the central longitudinal axis of the cue stick, wherein the sleeve is operative to move in simultaneous sliding contact with the first pair of the guide surfaces on a first side of the cylindrical outer surface of the sleeve, and with the at least one further guide surface on an opposed second side of the cylindrical outer surface of the sleeve.

16. The apparatus according to claim 15, wherein the hollow interior of the sleeve includes a first inner diameter adjacent the front end of the sleeve, wherein the hollow interior of the sleeve includes a second inner diameter adjacent the back end of the sleeve, wherein the first inner diameter is smaller than the second inner diameter.

17. The apparatus according to claim 16, wherein the hollow interior of the sleeve includes at least one deformable member, wherein the at least one deformable member includes a first aperture with the first inner diameter, wherein the at least one deformable member includes a second aperture with the second inner diameter.

18. The apparatus according to claim 13, wherein the guide includes a base, wherein the base includes at least three spaced apart posts extending upwardly from the base, wherein the at least three posts respectively include the at least three guide surfaces.

19. The apparatus according to claim 13, wherein the guide includes a base, wherein the base includes two vertical, spaced apart, and parallel flat wall surfaces in operative connection with the base, wherein a first one of the wall surfaces includes the pair of guide surfaces, wherein the second one of the wall surfaces includes the at least one further guide surface.

20. An apparatus comprising:

an adapter, wherein the adapter includes a cylindrical sleeve that is operative to removably mount around a cue stick, wherein the cue stick includes a back end and a front end, wherein the cue stick includes a length between the back end and the front end, wherein the cue stick includes an outer surface that tapers from the back end to the front end, wherein the cue stick includes a central longitudinal axis that extends from the back end to the front end of the cue stick, wherein the sleeve includes a cylindrical outer surface, wherein the cylindrical outer surface includes an outer diameter, wherein the sleeve includes a hollow interior, wherein the sleeve includes a back end and a front end, wherein the sleeve includes a length between the back end and the front end, wherein the length of the sleeve is less than the length of the cue stick, wherein the back end of the sleeve includes an opening to the hollow interior, wherein the front end of the sleeve includes an opening to the hollow interior, wherein the sleeve includes a central longitudinal axis that extends from the back end to the front end of the sleeve, wherein the hollow interior of the sleeve includes a first deformable ring with a first aperture with a first inner diameter adjacent the front end of the sleeve, wherein the hollow interior of the sleeve includes a second deformable ring with a second aperture with a second inner diameter adjacent the back end of the sleeve, wherein the first inner diameter is smaller than the second inner diameter, wherein when the cue stick is inserted into the sleeve, the first deformable ring adjacent the front of the sleeve and the second deformable ring adjacent the back of the sleeve deform to tightly engage the sleeve with the cue stick such that the sleeve is mounted around the outer surface of the cue stick in a first position in which the cue stick extends through the hollow interior and engages with the sleeve so as to maintain the central longitudinal axis of the sleeve orientated at least one of parallel and coincident to the central longitudinal axis of the cue stick; and a guide, wherein the guide includes at least two laterally spaced apart guide surfaces operative to receive the sleeve in sliding contact therebetween with each of the at least two guide surfaces simultaneously contacting the cylindrical outer surface of the sleeve, wherein a distance between the at least two guide surfaces corresponds to the outer diameter of the cylindrical outer surface of the sleeve, wherein the sleeve is operative to simultaneously move relative to the guide in sliding contact between the at least two guide surfaces, in a direction parallel to the longitudinal axis of the cue stick and in a direction perpendicular to the longitudinal axis of the cue stick.

* * * * *